United States Patent [19]

Mayer

[11] Patent Number: 4,785,148

[45] Date of Patent: Nov. 15, 1988

[54] BROAD-BAND ABSORPTIVE TAPE FOR MICROWAVE OVENS

[76] Inventor: Ferdy Mayer, 10-21 rue de Lourmel, 75015 Paris, France

[21] Appl. No.: 945,974

[22] Filed: Dec. 24, 1986

[30] Foreign Application Priority Data

Dec. 24, 1985 [FR] France ..... 85 19142

[51] Int. Cl.[4] ..... H05B 9/06

[52] U.S. Cl. ..... 219/10.55 D; 174/35 GC; 174/35 MS; 252/62.51

[58] Field of Search ..... 219/10.55 D, 10.55 R, 219/10.55; 174/35 GC, 35 MS; 252/62.51

[56] References Cited

U.S. PATENT DOCUMENTS 3,742,176 6/1973 Ishino ..... 219/10.55 D
4,046,983 9/1977 Ishino ..... 219/10.55 D

*Primary Examiner*—A. D. Pellinen

*Assistant Examiner*—Leon K. Fuller

*Attorney, Agent, or Firm*—Sughrue, Mion, Zinn, Macpeak & Seas

[57] ABSTRACT

Absorptive tape or gasket for microwave ovens, set up in the leakage path of microwave energy, and filling at least partially such passage, consisting in an absorptive magnetic compound:

where the compound consists in a powder or mixture of powders of ferrites, in an organic matrix (such as a plastic, rubber, polymer, etc.), where this or these ferrite(s) is (are) represented by the general formula $MO(Fe_2O_3)$, where M represents a bivalent metal, or mixture of bivalent metals, such as Fe, Ni, Cu, Zn, Mg, with a weight percentage of over 80%, and where this compound does present no resonance effects, i.e. presents a Q-factor substantially equal or less than unity, over the frequency range of 2,45 to over 12 GHz.

5 Claims, No Drawings

BROAD-BAND ABSORPTIVE TAPE FOR MICROWAVE OVENS

In a technical note diffused on March 1961, LEAD co-describes "absorptive gasket and tapes for the implementation of microwave suppression, based upon ferrite powders loaded plastics or polymers".

Since then, a number of absorptive tapes and gaskets have been described in the literature, more particularly to suppress microwave oven door leakage.

For example, U.S. Pat. Nos. 3,742,176 and 3,866,000 describe magnetic absorptive compounds, for such purpose, loaded with 20% to 80% weight with Ni, Cu, Zn or Mg ferrites.

The unsatisfactory performance of such compounds appears clearly in the U.S. Pat. No. 4,046,983, where an additional design factor is emphasized, using a special dimensioning of the tape or gasket, in the direction of the leakage wave propagation: a multiple integral of $\lambda/2$, where $\lambda$ represents the wavelength in the absorptive composite material, so introduces a resonance, with a maximum of absorption, for the oven fundamental frequency of 2,45 GHz.

It has become known more recently that such ovens radiate parasitic power around the 2,45 GHz nominal frequency (because of parasitic modulation and magnetron stability effects) and additionally on higher harmonic frequencies.

More particularly, harmonic 5, i.e. leakage in the range of 12,25 GHz, leaks through the different joints, holes, etc. of the oven—including the door opening joint.

On the other hand, TV-satellite bands have been placed unfortunately in the 12 GHz band: it became so obvious that a recent standard (VDE 871) limited this nuisance radiation of microwave ovens to a very low value, and consequently absorptive tapes and gaskets had to become broadband, so as to cover 2,45 to 12,25 GHz, and additionally, no resonance effects can be used anymore.

A first aim of the present invention is to describe a very broad band tape and gasket, with improved absorption, covering 2,45 to 12,25 GHz.

Such a broad band is achieved by suppressing resonance effects, and by implementing magnetic absorption losses (due to ferrites in the compound) and dielectric losses (of the compound) equal or higher than the corresponding reactive effects, which sum is substantially approaching or higher than unity.

In classical "radio-engineer" terms, the compound must represent a Q-factor substantially equal or less than one: it is well-known that, by definition, all resonances disappear: the compound is absorptive, independently from frequency.

It is a second aim of the present invention, to achieve a predetermined characteristic wave-impedance, combined with the above. Indeed, so as to optimize leakage absorption, with an only partial filling of the leakage path with the compound, one can show that the wave-impedance of the compound (equal to the square-root of the ratio of magnetic permeability over the dielectric permittivity of the compound) must be as high as possible, so as to approach or equal the free-space wave impedance (377Ω).

Indeed, the wave-impedance of typical absorptive compounds, is in general much less than 377Ω, by the fact that magnetic permeabilities achievable practically, are inferior ro permittivities, over the interesting frequency range.

The wave-impedance so will be much less than 377Ω, and the leaking wave (with the air-gap of the door joint) will have the tendency to go around the tape or gasket: it will not be absorbed.

Details of this mechanism have been described in detail, in the inventor's presentation "EMI Design for leakage and radiation suppression from microwave-ovens" at the Fifth International Conference on Electromagnetic Compatibility, University of York, England, Sept. 30–Oct. 3, 1986.

Following the invention, such broad-band absorptive compound may be implemented with ferrites, of the general formula $MO(Fe_2O_3)$, where M represents a bivalent metal or mixture of bivalent metals, such as Fe, Ni, Cu, Zn, Mn, Mg, with a low-frequency permeability higher than 200, and preferably higher than 1000, with a concentration of such ferrite, as powder, in an organic matrix (such as plastic, rubber, polymer, etc.), with a weight concentration above 80%.

The additional important requirement is a high resistivity of such ferrites (for example, above 50 Ωcm, and preferably above 1000 Ωcm), achieved through a thermal processing (known in the art) of the ferrite, or the ferrite powder (before mixing), suppressing, at least on the surface of the grains, coexistent bivalent and trivalent metallic ions.

Typically, compounds implemented following the rules of British Pat. No. 2012097, using Mn-Zn or Fe-Mn-Zn ferrites with high permeability, but with the additional high resistivity, represent at the same time the broad-band absorption spectrum, from a fraction of 1 GHz to above 15 GHz and the high wave-impedance of the compound, by a reduced permittivity of the compound, due to the high resistivity of the ferrite, and to a lesser degree, to a low dielectric constant of the matrix material.

Such a compound will be essentially insulating, in opposition to non magnetic absorptive tapes and gaskets, where the absorption is only due to conductivity.

In the referenced presentation, typical absorption spectra are shown, with the above compound—showing a free-wave absorption of over 30 dB/cm over the 2,45 GHz to 12 GHz range—. Typical market-available material performance is such that two kinds of material are needed to cover the range, (with 20 dB/cm mimima attenuation).

The ideal high wave impedance of such a compound is difficult to achieve, over the broad frequency range, and consequently, there may be interfacial resonances (due to wave reflexions at the entrance, and at the exit, of the wave, in the tape or gasket). It is a third aim of the present invention to give the tape or gasket a progressive cross-section, in the wave direction, at the entrance and/or the exit of the wave.

It is a fourth aim of the present invention to broaden still more, if need be, the absorptive frequency range, by using several ferrite powders in the compound, where each represents a maximum sum of loss angles, as described, over a part of the needed frequency range, in such a way that such loss angles complete each other, inside the range, so as to achieve the conditions of maximum loss and high wave impedance.

Typically, a Mn-Zn or Fe-Mn-Zn ferrite with medium permeability (where the absorption spectrum barely extends over a few GHz), can be combined with a Ni-Zn ferrite, rich in Zn (i.e. medium permeability, where the absorption spectrum has its maximum over the few GHz), in the composite, so as to broaden the absorption frequency band, and to optimize the wave-impedance.

I claim:

1. Absorptive tape or gasket for microwave ovens, positioned in a leakage path of microwave energy, and filling at least partially such passage, comprising an absorptive magnetic compound:

wherein the compound consists of a powder or mixture of powders of ferrites, in an organic matrix, where the powder or mixture is represented by the general formula $MO(Fe_2O_3)$, where M represents a bivalent metal, or mixture of bivalent metals, selected from the group consisting of Fe, Ni, Cu, Zn, Mn, and Mg, with a weight percentage of over 80%, and where the ferrite in this compound has a low frequency permeability higher than 200, said powder or mixture having a resistivity greater than 50 Ω-cm.

2. Absorptive tape or gasket according to claim 1, wherein the organic matrix comprises a material selected from the group consisting of plastic, rubber, and polymer.

3. Absorptive tape or gasket according to claim 1, wherein the low frequency permeability of the ferrite is greater than 1,000.

4. Absorptive tape or gasket according to claim 1, wherein the resistivity of said ferrite powder is greater than 1,000 Ω-cm.

5. Absorptive tape or gasket according to claim 1, 3, 4, or 2, where one or both side(s) of the tape or gasket, in the leakage direction, is (are) level-edged, so as to achieve a progressive wave-matching to avoid internal reflexions and consequent frequency-selective absorptive effects.

* * * * *